US011044557B2

(12) United States Patent
Alcock

(10) Patent No.: US 11,044,557 B2
(45) Date of Patent: Jun. 22, 2021

(54) METHOD FOR DETERMINING A RESPONSE FUNCTION OF A NOISE CANCELLATION ENABLED AUDIO DEVICE

(71) Applicant: ams AG, Premstaetten (AT)

(72) Inventor: Robert Alcock, Thame (GB)

(73) Assignee: AMS AG, Premstaetten (AT)

( * ) Notice: Subject to any disclaimer, the term of this patent is extended or adjusted under 35 U.S.C. 154(b) by 0 days.

(21) Appl. No.: 16/759,638

(22) PCT Filed: Oct. 23, 2018

(86) PCT No.: PCT/EP2018/079027
§ 371 (c)(1),
(2) Date: Apr. 27, 2020

(87) PCT Pub. No.: WO2019/086298
PCT Pub. Date: May 9, 2019

(65) Prior Publication Data

US 2020/0288244 A1 Sep. 10, 2020

(30) Foreign Application Priority Data

Nov. 2, 2017 (EP) ..... 17199694

(51) Int. Cl.
*H04R 3/04* (2006.01)
*H04R 5/033* (2006.01)
*H04R 5/04* (2006.01)

(52) U.S. Cl.
CPC ..... *H04R 3/04* (2013.01); *H04R 5/033* (2013.01); *H04R 5/04* (2013.01); *H04R 2460/01* (2013.01)

(58) Field of Classification Search
CPC . H04R 3/04; H04R 5/033; H04R 5/04; H04R 2460/01; H03G 3/32
(Continued)

(56) References Cited

U.S. PATENT DOCUMENTS 5,138,644 A 8/1992 McArdle et al.
7,957,549 B2 * 6/2011 Chiba ..... H04R 1/1016 381/328
(Continued)

FOREIGN PATENT DOCUMENTS

| | | |
|---|---|---|
| GB | 2445984 | 7/2008 |
| WO | 2017/029550 | 2/2017 |
| WO | 2017/129951 | 8/2017 |

OTHER PUBLICATIONS

European Patent Office, International Search Report for PCT/EP2018/079027 dated Jan. 25, 2019.

*Primary Examiner* — Xu Mei
(74) *Attorney, Agent, or Firm* — MH2 Technology Law Group LLP

(57) ABSTRACT

In a method for determining a response function of a noise cancellation enabled audio device, the audio device is placed onto a measurement fixture, wherein a loudspeaker of the audio device faces an ear canal representation of the measurement fixture. A first and a second response function between an ambient sound source and a test microphone located within the ear canal representation are measured while parameters of a noise processor of the audio device are set to a proportional transfer function with respective first and second gain factors being different from each other. A model response function is determined based on the first and the second response function and on the first and the second gain factor.

20 Claims, 2 Drawing Sheets

(58) Field of Classification Search
USPC ..... 381/71.1, 71.6, 72, 74, 317, 328, 57
See application file for complete search history.

(56) References Cited

U.S. PATENT DOCUMENTS

| | | | | |
|---|---|---|---|---|
| 9,706,288 | B2 * | 7/2017 | Terlizzi | H04R 1/1091 |
| 10,834,494 | B1 * | 11/2020 | Tong | G10K 11/17854 |
| 2006/0093159 | A1 * | 5/2006 | Koh | H04R 3/04 381/98 |
| 2013/0039507 | A1 * | 2/2013 | Park | G10K 11/17813 381/71.6 |

* cited by examiner

METHOD FOR DETERMINING A RESPONSE FUNCTION OF A NOISE CANCELLATION ENABLED AUDIO DEVICE

BACKGROUND OF THE INVENTION

The present disclosure relates to a method for determining a response function of a noise cancellation enabled audio device, e.g. headphone.

Nowadays a significant number of headphones, including earphones, are equipped with noise cancellation techniques. For example, such noise cancellation techniques are referred to as active noise cancellation or ambient noise cancellation, both abbreviated with ANC. ANC generally makes use of recording ambient noise that is processed for generating an anti-noise signal, which is then combined with a useful audio signal to be played over a speaker of the headphone. ANC can also be employed in other audio devices like handsets or mobile phones.

Various ANC approaches make use of feedback, FB, microphones, feedforward, FF, microphones or a combination of feedback and feedforward microphones.

FF and FB ANC is achieved by tuning a filter based on given acoustics of a system.

Several methods are known to measure the acoustical and electrical paths in a feedforward ambient noise cancellation headphone and to derive the ideal filter for an ambient noise cancellation system.

One standard method for deriving the ideal shape of the filter was thoroughly described by Kimura et al in U.S. Pat. No. 5,138,664. The method involves measuring the individual response functions AE, AM, DE as illustrated in FIG. 1 using standard laboratory equipment, such as a spectrum analyser, then combining the responses to yield the ideal ANC filter shape.

Developments of Kimura's method are described in patent GB 2445984 B, further disclosing a filter design tool that determines values for the ANC filter parameters.

The disadvantage of prior art methods is that they require access to test-points and stimulus points inside the headphone to make the measurements. These are not usually accessible when the headphone is fully assembled. The electro-acoustical transfer functions can also change as components of the headphone are fitted. For example when enclosing a PCB, the acoustical pathways through the headphone change. Also when fitting batteries, the mass of a headphone shell changes, causing the resonant characteristics to change. Inter alia for these reasons, prior art methods are less accurate.

SUMMARY OF THE INVENTION

The present disclosure provides an improved measurement concept for noise cancellation in an audio device like a headphone or handset that allows to improve noise reduction performance.

The improved measurement concept is based on the insight of understanding of systematic errors embedded in prior art methods of characterizing headphone acoustics. It was appreciated that unless measurements were made on a final product, the measurements were flawed, which would lead to degraded performance. Hence, according to the improved measurement concept, the measurements can be made when the headphone or other ANC enabled audio device is fully assembled, without changing the physical design of the device to accommodate special test ports, resulting in elimination of systematic errors associated with assembly. Instead of a headphone, the noise cancellation enabled audio device could also be a handset, a mobile phone or a similar device.

One aspect of the improved measurement concept is to understand how different paths through the electrical system of the device can be modified in a way that allows the internal electro-acoustical transfer functions to be extracted.

Using the improved measurement concept, all of the measurements can be performed by measuring the acoustical response from an ambient sound source, e.g. an ambient speaker, to a test microphone located within an ear canal representation of a measurement fixture, e.g. an ear-canal microphone, under different conditions. This makes the process very simple and less error prone. In contrast, conventional methods make three measurements requiring the apparatus to be configured in at least two different ways. For example, the test microphone is located at a position within the ear canal representation corresponding to the eardrum of a user. This point can also be called the drum reference point, DRP.

A further benefit of the improved measurement concept is that since the measurements are made with the signals passing through the ANC processor, the resulting model transfer function automatically includes the response shapes or delays (such as input and output coupling, analog-to-digital conversion and digital-to-analog conversion) associated with the ANC processor.

In summary, the proposed method simplifies the process of making accurate acoustic response measurements and avoids that a measurement error will corrupt the result. The consequence is that the acoustical noise reduction performance will increase for headphones or other ANC enabled audio devices developed using the method.

The improved measurement concept is able to solve the measurement issues for two groups of people: First, the headphone designer in the acoustics lab will be able to create more accurate filters using this method. Second, an OEM could potentially use the method on the production line as part of the quality control process to select an ANC filter that is optimized for each accessory. This would help to compensate for slight variations in acoustic response during manufacture.

In an embodiment according to the improved measurement concept, a method for determining a response function of a noise cancellation enabled audio device, in particular a headphone, comprises placing the audio device onto a measurement fixture, wherein a loudspeaker of the audio device faces an ear canal representation of the measurement fixture. A first response function between an ambient sound source and a test microphone located within the ear canal representation is measured while parameters of the noise processor of the audio device are set to a proportional transfer function with a first gain factor. Similarly, a second response function between the ambient sound source and the test microphone is measured while parameters of the noise processor are set to a proportional transfer function with a second gain factor being different from the first gain factor. A model response function for the noise processor is determined based on the first response function, the second response function and the first and the second gain factors.

For example, the model response function is an ideal representation of a transfer function of a filter of the noise processor to achieve optimum noise cancellation performance. Hence the model response function can be the basis for trimming filter parameters of the noise processor to match the model response function as well as possible.

Accordingly, in various embodiments the method further comprises determining parameters of a filter function of the noise processor based on the model response function.

In some implementations, the method further comprises determining an ambient-to-ear response function based on the first and/or the second response function, and determining an overall processor response function based on the first response function, the second response function and the first and the second gain factor. The model response function is determined from the ambient-to-ear response function and the overall processor response function. In particular, the overall processor response function represents a combined transfer function from the ambient sound source to a microphone of the audio device and from the loudspeaker of the audio device to the test microphone.

Expressed as a formula, with AE being the ambient-to-ear response function and AM.DE being the overall processor response function, the model response function F can be expressed as $$F = -\frac{AE}{AM.DE}. \tag{1}$$

Accordingly, the model response function F may be determined according to the formula $$F = a1 - \frac{X(a2 - a1)}{Y - X}, \tag{2}$$

with a1 being the first gain factor, a2 being the second gain factor, X being the first response function and Y being the second response function:

In some implementations a third response function is measured between the ambient sound source and the test microphone while parameters of the noise processor are set to a proportional transfer function with a third gain factor being different from both the first gain factor and the second gain factor. In such an implementation the model response function is determined based on the first, the second and the third response function, and on the first, the second and the third gain factor.

For example, in such implementations with three measurements, an ambient-to-ear response function is determined based on the first response function or on the first, the second and the third response function. An overall processor response function is determined based on the first, the second and the third response function and on the first, the second and the third gain factor. Similar to the implementation with two response function measurements, the model response function is determined from the ambient-to-ear response function and the overall processor response function. For example, equation (1) can also be applied in this case.

For example, in the three measurements case, the model response function F can be determined according to the formula $$F = a1 - \frac{X(a3 - a2)}{Z - Y}, \tag{3}$$

with a1 being the first gain factor, a2 being the second gain factor, a3 being the third gain factor, X being the first response function, Y being the second response function and Z being the third response function.

In some configurations of audio devices worn by a user, leakage between the loudspeaker of the audio device and the feedforward ANC microphone of the audio device may occur. The acoustical leakage pathway may be through the internal vents in the structure of the audio device or through a leakage in the seal between the audio device and the user. The acoustical pathway may be negligible. However, in some implementations with three response function measurements, a leakage response function is determined based on the first, the second and the third response function and on the first, the second and the third gain factor. Then, the overall processor response function is determined further based on the leakage response function.

For example, the leakage response function represents a combined transfer function between output and input of the ANC-enabled audio device and the transfer function between the audio device's loudspeaker and the test microphone, respectively the user's eardrum, also called a driver-to-ear response function.

With the three measured response functions and three unknown response functions, namely the ambient ear response function, the overall processor response function and the leakage response function, an equation system can be formed representing the various acoustic paths. The solution to this equation system allows to find the model response function according to equation (1).

In the two or three measurement configurations with the noise processor being set to a proportional transfer function, a more or less frequency-independent transfer function for the noise processor is set having the respective defined gain factor. The frequency independence is at least given in a frequency range of interest.

In various implementations, the first gain factor equals 0. Hence, with the first gain factor being 0, no signal is output by the loudspeaker of the audio device during the measurement. For example, the noise processor is disabled and/or muted during the measurement of the first response function to achieve the zero gain factor.

Setting the first gain factor to zero may ease the determination of the model response function, because the measured first response function directly corresponds to the ambient-to-ear response function in this case.

It has been further found that there is a more general set of measurements that allow the model response function to be evaluated. In particular, the more general solution is that the noise processor implements different but known and predefined filter transfer functions for each measurement instead of only using the proportional transfer functions with respective gain factors. After making measurement for the first, second and, optionally, third response functions, one can compensate for the known response functions implemented by the noise processor.

One scenario where this might be useful is to configure the noise processor with an ANC filter for all measurements. The improved method will then yield an "error" function that must be added to the implemented ANC filter that will yield better ANC. This could be useful when implementing an analog ANC solution which had more than one filter stages. In this scenario the method could be run once for each filter stage, and provide a successively improved ANC filter.

A second scenario is where you choose to implement different but known filters for the two or three measurements. The reason for implementing the filters might be to improve the signal-to-noise ratio of the measurements. One would have to correct for these known filter shapes after calculating the individual first, second and, optionally, third response functions. Preferably, the predefined filter transfer functions only differ by an overall gain factor applied.

Accordingly, in a further embodiment according to the improved measurement concept, a method for determining a model response function of a noise cancellation enabled audio device, in particular a headphone, comprises placing the audio device onto a measurement fixture, wherein a loudspeaker of the audio device faces an ear canal representation of the measurement fixture. A first response function between an ambient sound source and a test microphone located within the ear canal representation is measured while parameters of the noise processor of the audio device are set to a predefined transfer function in combination with a first gain factor. Similarly, a second response function between the ambient sound source and the test microphone is measured while parameters of the noise processor are set to the predefined transfer function in combination with a second gain factor being different from the first gain factor. A model response function for the noise processor is determined based on the predefined transfer function, the first response function, the second response function and the first and the second gain factor.

In some of such implementations a third response function is measured between the ambient sound source and the test microphone while parameters of the noise processor are set to the predefined transfer function in combination with a third gain factor being different from both the first gain factor and the second gain factor. In such an implementation the model response function is determined based on the predefined transfer function, the first, the second and the third response function, and on the first, the second and the third gain factor.

Measuring the various response functions may be accomplished by playing a test signal from the ambient sound source, recording a response signal with the test microphone in response to the played test signal and determining, e.g. calculating, the response function from the test signal and the response signal. The test signal may be a combination of various discrete frequency signals or a specific noise test pattern or the like. The measured response functions may be determined using a spectrum analyzer, for example.

In all the implementations described above, each of the response functions measured between the ambient sound source and the test microphone may be measured without accessing any test point within the audio device. Similarly, each of the response functions measured between the ambient sound source and the test microphone may be measured without the audio device being disassembled during the respective measurements.

For example, the audio device and the noise processor are enabled for feedforward noise cancellation.

BRIEF DESCRIPTION OF THE DRAWINGS

The improved measurement concept will be described in more detail in the following with the aid of drawings. Elements having the same or similar function bear the same reference numerals throughout the drawings. Hence their description is not necessarily repeated in following drawings.

In the drawings.

DETAILED DESCRIPTION

Figure 1:
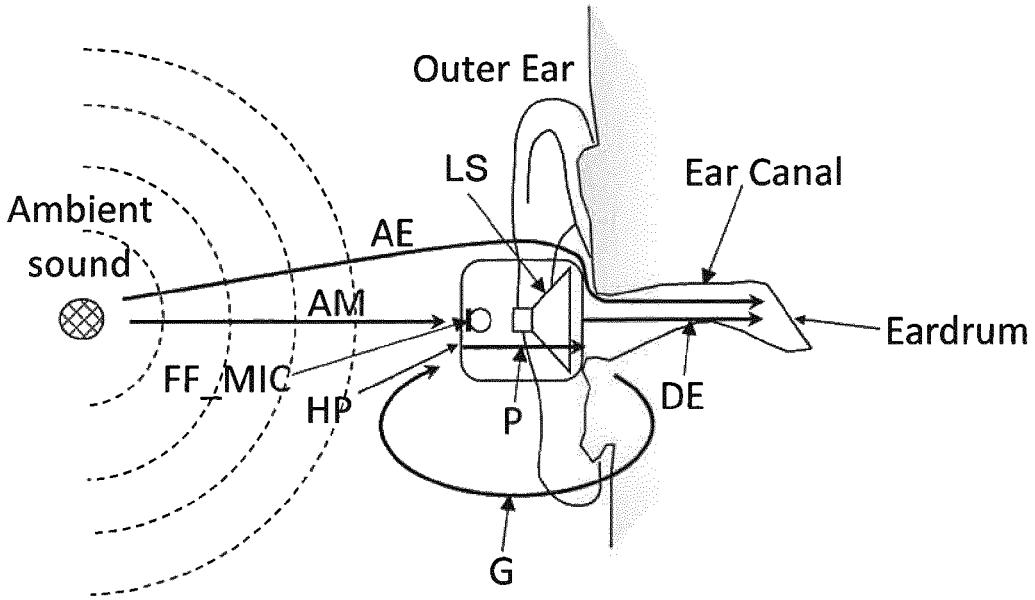
FIG. 1 shows an example headphone worn by a user with several sound paths from an ambient sound source.

FIG. 1 shows an example configuration of a headphone HP worn by a user with several sound paths from an ambient sound source. The headphone HP shown in FIG. 1 stands as an example for any noise cancellation enabled audio device and can particularly include in-ear headphones or earphones, on-ear headphones or over-ear headphones. Instead of a headphone, the noise cancellation enabled audio device could also be a mobile phone or a similar device.

The headphone HP in this example features a microphone FF_MIC, which is particularly designed as a feedforward noise cancellation microphone, and a loudspeaker LS. Internal processing details of the headphone HP are not shown here for reasons of a better overview.

In the configuration shown in FIG. 1, several sound paths exist, of which each can be represented by a respective response function or transfer function. For example, an ambient-to-ear sound path AE represents the sound path from an ambient sound source to a user's eardrum through the user's ear canal. A sound path from the ambient sound source to the microphone FF_MIC can be represented by the response function AM, also called ambient-to-mic response function AM. A response function or transfer function of the headphone HP, in particular between the microphone FF_MIC and the loudspeaker LS, can be represented by a processor function P which may be parameterized as a noise cancellation filter during regular operation. The specification DE represents the acoustic path between the headphone's loudspeaker LS and the eardrum, and may be called a driver-to-ear response function. A further path, G, can be taken into account from the headphone HP to the feedforward microphone FF_MIC which occurs through internal and/or external leakages in the headphone HP. This path G may represent a Driver to Feedforward Microphone FF MIC response and may also be called a leakage response or leakage path.

Accordingly, during operation, one direct sound path, namely the sound path AE and one combined sound path from the ambient sound source to the eardrum exist. The combined sound path results from the combination of sound path AM, processor path P, which incorporates the frequency responses of all the electrical elements of the noise cancellation electronics, and the driver-to-ear sound path DE. The combined sound paths may be written as AM.P.DE.

For optimum noise cancellation performance, the processor noise path P may be parameterized to represent more or less the model response function F as defined in equation (1), such that $$P \approx F = -\frac{AE}{AM.DE}. \tag{4}$$

Figure 2:
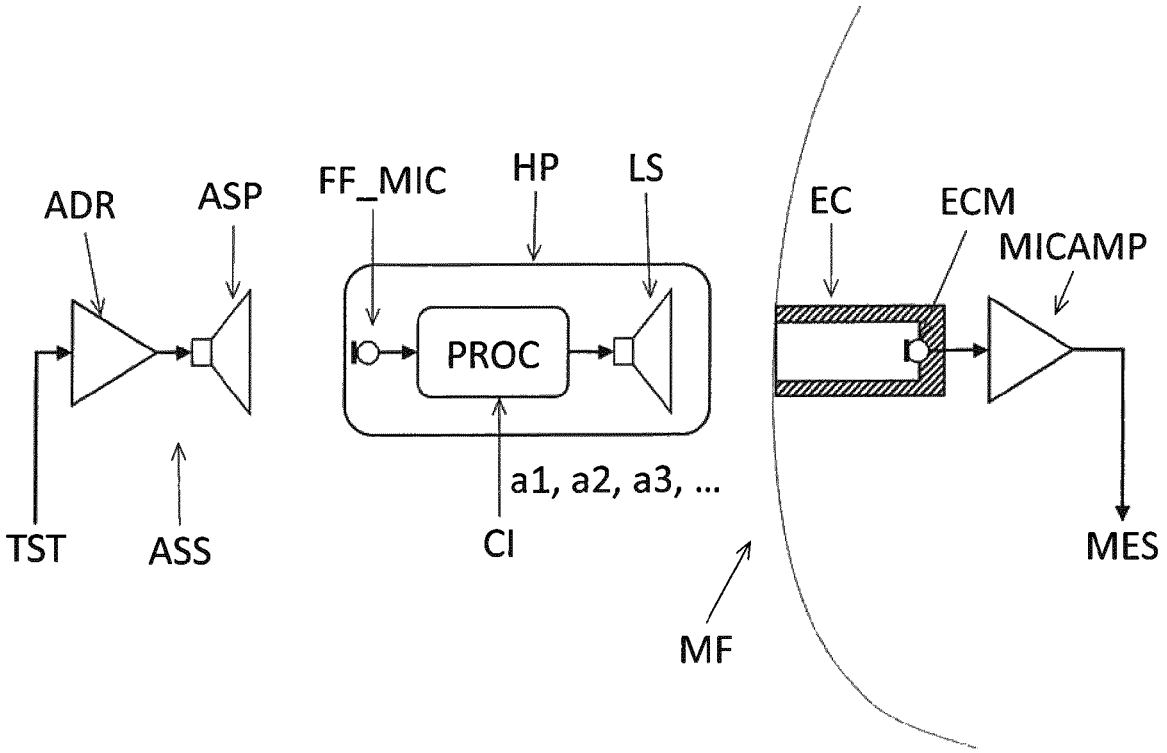
FIG. 2 shows an example implementation of a measurement configuration according to the improved measurement concept.
Figure 3:
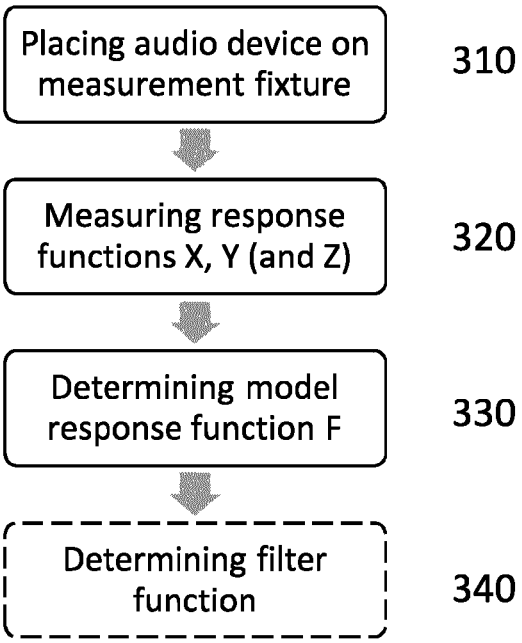
FIG. 3 shows an example implementation of a method according to the improved measurement concept.

The determination of the model response function F will be explained in more detail in conjunction with an example implementation of a measurement configuration as shown in FIG. 2, and an example flow diagram of a corresponding method as shown in FIG. 3.

FIG. 2 shows an example implementation of a measurement configuration according to the improved measurement concept including an ambient sound source AS comprising an ambient amplifier ADR and an ambient speaker ASP for playing a test signal TST. The noise cancellation enabled audio device HP comprises the microphone FF_MIC, whose signal is processed by a noise processor PROC and output via the loudspeaker LS. The noise processor PROC features a control interface CI, over which processing parameters of the noise processor PROC can be set, like filter parameters or gain factors a1, a2, a3 for respective proportional transfer functions. The audio device HP is placed onto a measurement fixture MF, which may be an artificial head with an ear canal representation EC, at the end of which a test microphone ECM is located for recording a measurement signal MES via a microphone amplifier MICAMP. It should be noted that at least the measurement fixture MF and the ambient sound source AS are represented with their basic functions, namely playing a test signal TST and recording a measurement signal MES without excluding more sophisticated implementations.

Referring now to FIG. 3, an example block diagram showing a method flow of a method for determining a response function of a noise cancellation enabled audio device, in particular headphone, is shown. The method may be operated with the example measurement setup shown in FIG. 2.

As shown in block 310, as a prerequisite the audio device is placed onto the measurement fixture MF, such that a loudspeaker LS of the audio device HP faces the ear canal representation EC of the measurement fixture MF.

Block 320 includes the measuring of two or more response functions X, Y and, optionally, Z. Each of the response functions is measured between the ambient sound source AS and the test microphone ECM located within the ear canal representation EC that preferably emulates the position of a user's eardrum.

According to the improved measurement concept, for each of the response functions to be measured parameters of the noise processor PROC are set to a proportional transfer function with a specific gain factor. For example, the first response function X is measured with the first gain factor chosen to a factor a1, the second response function Y is measured with the second gain factor set to a factor a2, and the third, optional, response function Z is measured with the third gain factor set to a factor a3. All gain factors a1, a2 and a3 are chosen differently.

Measurement of the response functions X, Y and Z for example is performed by playing an appropriate test signal TST from the ambient sound source AS and recording an associated response signal MES with the test microphone ECM. The response functions X, Y and Z can then be determined from the test signal TST and the corresponding response signal MES. For example, the measured response functions X, Y and Z represent a frequency response having phase and amplitude over a given frequency range. Such frequency responses may also be represented with a complex notation with real part and imaginary part, which is well-known in the field of signal processing.

Referring now to block 330 of FIG. 3, a model response function F is determined based on at least the first and the second response functions X, Y and the associated gain factors a1, a2. In some implementations, also the optional third response function Z and the corresponding third gain factor a3 may be used.

The model response function F represents the ideal response of the noise processor PROC for an optimum noise cancellation performance based on the measurements performed before.

Hence, in optional block 340, a filter function for the processor PROC can be determined based on the model response function F. In particular, parameters of a filter function of the processor PROC can be determined, for example with various design tools for adapting the filter parameters to the model response function F as close as possible or technically feasible.

Finally, the filter parameters determined this way can be used for normal operation of the audio device, e.g. if the audio device or headphone is used by a user.

Figure 4:
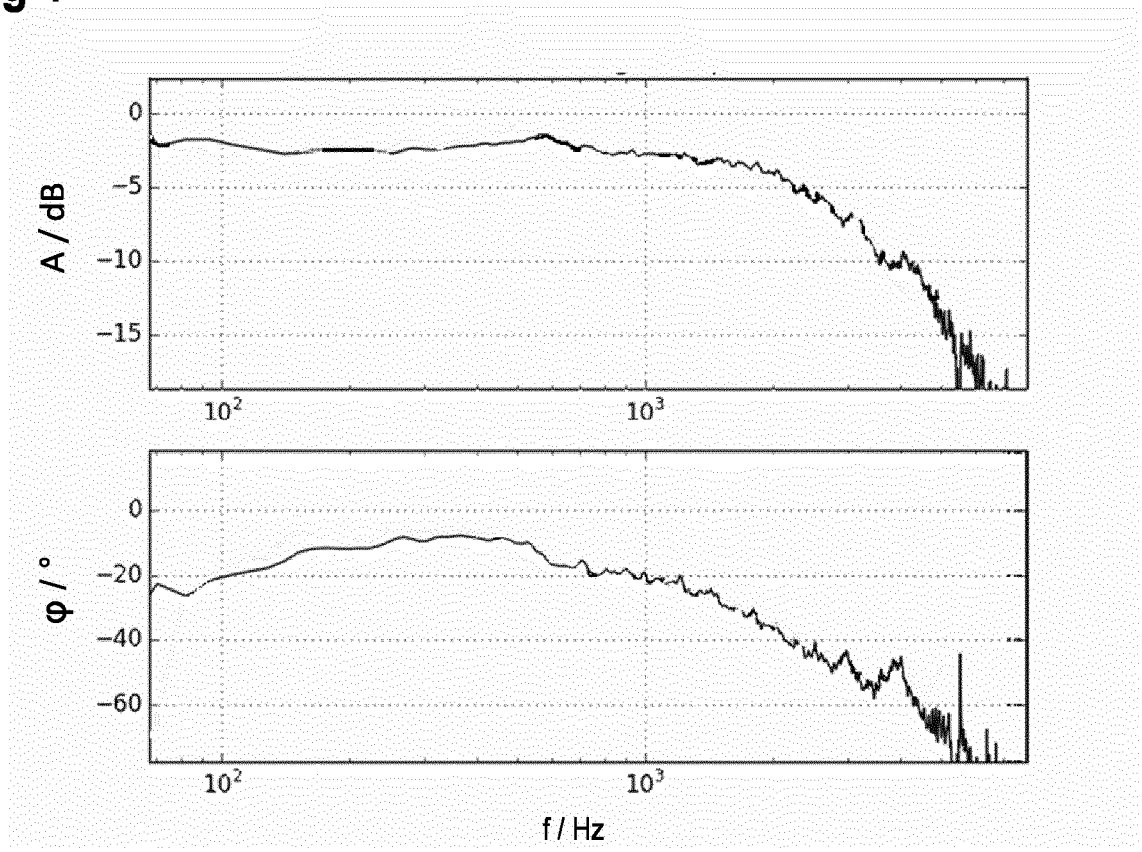
FIG. 4 shows an example frequency response of a model response function.

Referring to FIG. 4, an example frequency response of a model response function F is shown with its amplitude in the upper diagram and its phase in the lower diagram.

The filter function e.g. is designed such that the frequency response of the model response function F is matched as close as possible.

Referring back to FIG. 3, in the following various implementations of the method for determining the model response function will be explained in more detail.

For example, if the influence of the leakage path G is neglected, a response function M at the test microphone's ECM position basically results in the ambient-to-ear response function AE and a combination of the response function AM, the processor transfer function P and the driver to ear response function DE. This can hence be represented by $$M=AE+AM.P.DE, \tag{5}$$

with AM.P.DE representing the aforementioned combination.

In some implementations, two different measurements for a first response function X and a second response function Y are performed, wherein parameters of the noise processor PROC are set to a proportional transfer function with the first gain factor a1 for the first response function X and with the second gain factor a2 for the second response function Y. With equation (5), the first response function X can be written as $$X=AE+AM.a1.DE \tag{6}$$

and the second response function Y can be written as $$Y=AE+AM.a2.DE, \tag{7}$$

with a1, respectively a2, representing the processor transfer function P of equation (5).

Taking equations (6) and (7), the following equation can be derived $$Y-X=AM.(a2-a1).DE, \tag{8}$$

resulting in the following expression for the combined response of ambient-to-microphone AM and driver-to-ear DE:

$$AM.DE=\frac{Y-X}{a2-a1}. \tag{9}$$

Starting, for example, from equation (6), the ambient-to-ear response function AE can be derived as $$AE = X - AM.a1.DE = X - a1 \cdot \frac{Y - X}{a2 - a1}. \quad (10)$$

Inserting the expressions of equations (9) and (10) into equation (1), the model response function F can be written as $$F = a1 - \frac{X(a2 - a1)}{Y - X}. \quad (11)$$

In summary, the model response function F is determined when the headphone or other audio device is fully assembled and no access to internal test points or the like is necessary.

Equation (11) can be simplified, for example by choosing the first gain factor a1 to be zero, such that no signals are transferred from the audio device's microphone FF_MIC to its loudspeaker LS. Besides actually setting filter parameters of the processor transfer function P to achieve the zero gain factor, this can also be achieved by disabling and/or muting the noise processor PROC during measurement of the first response function X. In such a configuration, the model response function F simplifies to $$F = -a2 \frac{X}{Y - X}. \quad (12)$$

In some implementations also a third measurement can be performed, i.e. a third response function Z can be measured with a third gain factor a3 for the proportional transfer function of the noise processor PROC. Taking into account equation (5) again, this results in $$Z = AE + AM.a3.DE. \quad (13)$$

Similar to equation (9) above, the combined response AM.DE can now be determined from equations (7) and (13), resulting in $$AM.DE = \frac{Z - Y}{a3 - a2}. \quad (14)$$

In analogy to equation (10), the ambient-to-ear response function AE can be determined as $$AE = X - AM.a1.DE = X - a1 \cdot \frac{Z - Y}{a3 - a2}. \quad (15)$$

Using equation (1), the model response function F for example results in $$F = a1 - \frac{X(a3 - a2)}{Z - Y}, \quad (16)$$

wherein it would be apparent to the skilled reader that other combinations of the three measured response functions X, Y, Z were possible.

If the first gain factor a1 is chosen to be zero, as described above, equation (16) simplifies to $$F = -\frac{X(a3 - a2)}{Z - Y}. \quad (17)$$

Moreover, if for example the second and the third gain factor a2, a3 are chosen to a2=+1 and a3=−1, equation (17) further simplifies to $$F = \frac{2X}{Z - Y}. \quad (18)$$

While in the previous example implementations the leakage response G has been neglected, it can be considered in implementations as described in the following. For example, performing the measurement of the three response functions X, Y, Z as described above, these can be represented as $$X = (AE + AM.a1.DE)/(1 - G.a1.DE), \quad (19)$$

$$Y = (AE + AM.a2.DE)/(1 - G.a2.DE) \quad (20)$$

and $$Z = (AE + AM.a3.DE)/(1 - G.a3.DE). \quad (21)$$

With the three measurements, it is possible to determine the three unknowns AE, AM.DE and G.DE for finally finding a representation of the model response function F according to equation (1).

Taking an example implementation for such a configuration with the three gain factors a1, a2 and a3 chosen to be a1=0, a2=+1 and a3=−1, equations (19), (20) and (21) simplify to $$X = AE, \quad (22)$$

$$Y = (AE + AM.DE)/(1 - G.DE) \quad (23)$$

and $$Z = (AE - AM.DE)/(1 + G.DE). \quad (24)$$

With these simplifications, the combined leakage response G.DE, abbreviated as L, can be expressed as $$L = G.DE = \frac{2 * X - Y - Z}{Z - Y}. \quad (25)$$

The combined response function AM.DE can then be expressed as $$AM.DE = \tfrac{1}{2} \cdot (Y \cdot (1 - L) - Z \cdot (1 + L)). \quad (26)$$

Finally, using equations (22), (26) and (25), equation (1) can be rewritten as $$F = -2 \cdot X / (Y \cdot (1 - L) - Z \cdot (1 + L)). \quad (27)$$

In alternative implementations, it is also possible to use an approach where the noise processor PROC implements different but known and predefined filter transfer functions P for each measurement instead of only using the proportional transfer functions with respective gain factors a1, a2 and, optionally a3. After making measurements for the first, second and, optionally, third response functions X, Y and Z, one can compensate for the known response functions implemented by the noise processor PROC.

For example, different but known filters for the two or three measurements can be implemented, which can improve the signal-to-noise ratio of the measurements. One would have to correct for these known filter shapes after calculating the individual first, second and, optionally, third response functions X, Y and Z. Preferably, the predefined filter transfer functions only differ by an overall gain factor applied.

Accordingly, in such implementations, the filter transfer function P of the noise processor PROC may be set to a predefined transfer function R in combination with the respective gain factors a1, a2 and, optionally a3, such that two or three known filter functions result. This is similarly accomplished using the control interface CI. Based on equation (5), this results in equations similar to equations (6), (7) and (13), namely:

$$X=AE+AM.R.a1.DE, \tag{28}$$

$$Y=AE+AM.R.a2.DE, \tag{29}$$

and, optionally $$Z=AE+AM.R.a3.DE. \tag{30}$$

The model response function F for the noise processor PROC is determined based on the predefined transfer function R, the response functions X, Y, and optionally Z, and on the gain factors a1, a2 and, optionally, a3.

For example, the result of all the calculations yield an answer F/R instead of the desired answer F, which can be compensated for due to knowledge of the predefined transfer function R. Detailed implementation of the necessary equations can be readily derived by the skilled person from the description above for the implementation using gain factors a1, a2 and, optionally a3 only.

As mentioned before, the model response function F as determined with each of the example implementations described above, can be used as a model to design appropriate filter parameters for the transfer function P of the noise processor PROC. For example, respective filter parameters can be determined offline, having knowledge of the model response function F, and afterwards be transferred to the audio device or headphone HP via the control interface CI.

For example, a main beneficiary of the improved measurement concept is the acoustical engineer who designs the ANC headphone. The improved measurement concept allows the engineer to make more accurate measurements of a reference headphone design and in a more convenient way. It has a secondary application area on a headphone production line where it would allow measurements to be made that could be used to select the optimum ANC filter for each unit as it is produced.

REFERENCE NUMERALS

HP audio device
FF_MIC microphone
LS loudspeaker
AM ambient-to-microphone response function
AE ambient-to-ear response function
DE driver-to-ear response function
G leakage response function
P processor transfer function
F model response function
PROC noise processor
CI control interface
ASS ambient sound source
ADR ambient driver
ASP ambient speaker
EC ear canal representation
ECM test microphone
MICAMP microphone amplifier
TST test signal
MES measurement signal
MF measurement fixture

The invention claimed is:

1. A method for determining a response function of a noise cancellation enabled audio device, in particular headphones, the method comprising:

placing the audio device onto a measurement fixture, wherein a loudspeaker of the audio device faces an ear canal representation of the measurement fixture;

measuring a first response function between an ambient sound source and a test microphone located within the ear canal representation while parameters of a noise processor of the audio device are set to a proportional transfer function with a first gain factor;

measuring a second response function between the ambient sound source and the test microphone while parameters of the noise processor are set to a proportional transfer function with a second gain factor being different from the first gain factor;

determining a model response function for the noise processor based on the first response function, the second response function, the first gain factor, and the second gain factor.

2. The method according to claim 1, further comprising;

determining an ambient-to-ear response function based on the first and/or the second response function; and determining an overall processor response function based on the first response function, the second response function and the first and the second gain factor wherein the model response function; is determined from the ambient-to-ear response function and the overall processor response function.

3. The method according to claim 1, wherein the model response function F is determined according to the formula $$F = a1 - \frac{X(a2 - a1)}{Y - X},$$

with a1 being the first gain factor, a2 being the second gain factor, X being the first response function and Y being the second response function.

4. The method according to claim 1, wherein each of the response functions measured between the ambient sound source and the test microphone is measured without accessing any test point within the audio device.

5. The method according to claim 1, wherein each of the response functions measured between the ambient sound source and the test microphone is measured without the audio device being disassembled during the respective measurements.

6. The method according to claim 1, wherein the audio device and the noise processor are enabled for feedforward noise cancellation.

7. The method according to claim 1, further comprising determining parameters of a filter function of the noise processor based on the model response function.

8. A method for determining a response function of a noise cancellation enabled audio device, in particular headphones, the method comprising:

placing the audio device onto a measurement fixture, wherein a loudspeaker of the audio device faces an ear canal representation of the measurement fixture;

measuring a first response function between an ambient sound source and a test microphone located within the ear canal representation while parameters of a noise processor of the audio device are set to a proportional transfer function with a first gain factor;

measuring a second response function between the ambient sound source and the test microphone while parameters of the noise processor are set to a proportional transfer function with a second gain factor being different from the first gain factor;

measuring a third response function between the ambient sound source and the test microphone while parameters of the noise processor are set to a proportional transfer function with a third gain factor being different from the first gain factor and the second gain factor;

determining a model response function for the noise processor based on the first response function, the second response function, the third response function, the first gain factor, the second gain factor, and the third gain factor.

9. The method according to claim 8, further comprising;

determining an ambient-to-ear response function based on the first response function or on the first, the second and the third response function; and determining an overall processor response function based on the first, the second and the third response function and on the first, the second and the third gain factor; wherein the model response function is determined from the ambient-to-ear response function and the overall processor response function.

10. The method according to claim 8, wherein the model response function F is determined according to the formula $$F = a1 - \frac{X(a3 - a2)}{Z - Y},$$

with a1 being the first gain factor, a2 being the second gain factor, a3 being the third gain factor, X being the first response function, Y being the second response function and Z being the third response function.

11. The method according to claim 9, further comprising determining a leakage response function based on the first, the second and the third response function and on the first, the second and the third gain; wherein the overall processor response function is determined further based on the leakage response function.

12. The method according to claim 1, wherein the first gain factor equals zero.

13. The method according to claim 12, wherein the noise processor is disabled and/or muted during measurement of first response function.

14. A method for determining a response function of a noise cancellation enabled audio device, the method comprising:

placing the audio device onto a measurement fixture, wherein a loudspeaker of the audio device faces an ear canal representation of the measurement fixture;

measuring a first response function between an ambient sound source and a test microphone located within the ear canal representation while parameters of a noise processor of the audio device are set to a predefined transfer function in combination with a first gain factor;

measuring a second response function between the ambient sound source and the test microphone while parameters of the noise processor are set to the predefined transfer function in combination with a second gain factor being different from the first gain factor;

determining a model response function for the noise processor based on the predefined transfer function, the first response function, the second response function, the first gain factor, and the second gain factor.

15. The method according to claim 14, further comprising;

measuring a third response function between the ambient sound source and the test microphone while parameters of the noise processor are set to the predefined transfer function in combination with a third gain factor being different from the first gain factor and the second gain factor; wherein the model response function is determined based on the predefined transfer function, the first, the second and the third response function, and the first, the second and the third gain factor.

16. The method according to claim 15, wherein each of the response functions measured between the ambient sound source and the test microphone is measured without accessing any test point within the audio device.

17. The method according to claim 15, wherein each of the response functions measured between the ambient sound source and the test microphone is measured without the audio device being disassembled during the respective measurements.

18. The method according to according to claim 15, wherein the audio device and the noise processor are enabled for feedforward noise cancellation.

19. The method according to according to claim 15 further comprising determining parameters of a filter function of the noise processor based on the model response function.

20. The method according to claim 14, wherein the model response function F is determined according to the formula $$F = a1 - \frac{X(a2 - a1)}{Y - X},$$

with a1 being the first gain factor, a2 being the second gain factor, X being the first response function and Y being the second response function.

* * * * *